US010394160B2

(12) United States Patent
Yin et al.

(10) Patent No.: US 10,394,160 B2
(45) Date of Patent: Aug. 27, 2019

(54) TONER CARTRIDGE AND DEVELOPING CARTRIDGE FOR IMAGE FORMING APPARATUS, AND IMAGE FORMING APPARATUS

(71) Applicant: ZHUHAI SEINE TECHNOLOGY CO., LTD., Zhuhai (CN)

(72) Inventors: Aiguo Yin, Zhuhai (CN); Chaohao Huang, Zhuhai (CN); Li Wan, Zhuhai (CN)

(73) Assignee: ZHUHAI SEINE TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 16/025,007

(22) Filed: Jul. 2, 2018

(65) Prior Publication Data

US 2018/0314185 A1 Nov. 1, 2018

Related U.S. Application Data

(63) Continuation of application No. PCT/CN2016/109326, filed on Dec. 9, 2016.

(30) Foreign Application Priority Data

Dec. 31, 2015 (CN) ..... 2015 2 1124702 U

(51) Int. Cl.

| | |
|---|---|
| ***G03G 15/00*** | (2006.01) |
| ***G03G 15/08*** | (2006.01) |
| ***G03G 21/18*** | (2006.01) |

(52) U.S. Cl.

CPC ..... *G03G 15/0808* (2013.01); *G03G 15/0863* (2013.01); *G03G 21/1885* (2013.01);
(Continued)

(58) Field of Classification Search

CPC ..... G03G 21/1652; G03G 15/80; G03G 21/1867; G03G 15/0863
(Continued)

(56) References Cited

U.S. PATENT DOCUMENTS

2012/0039622 A1* 2/2012 Cho ..... G03G 21/1885 399/90

FOREIGN PATENT DOCUMENTS

CN 1459974 A 12/2003
CN 1854933 A 11/2006
(Continued)

OTHER PUBLICATIONS

The World Intellectual Property Organization (WIPO) International Search Report for PCT/CN2016/109326 dated Mar 1, 2017 6 Pages.

*Primary Examiner* — Walter L Lindsay, Jr.
*Assistant Examiner* — Frederick Wenderoth
(74) *Attorney, Agent, or Firm* — Anova Law Group, PLLC

(57) ABSTRACT

The present disclosure provides a toner cartridge for an image forming apparatus, a developing cartridge including the toner cartridge, and the image forming apparatus. The toner cartridge includes a housing, the housing includes a toner chamber configured to store toner, and a developing roller is disposed at a rear side of the housing. The toner cartridge also includes a storage member disposed on a lower surface of the housing and configured to store information of the toner cartridge; and with respect to the rear side of the housing for disposing the developing roller, the storage member is located closer to a front side of the housing opposite to the rear side.

17 Claims, 14 Drawing Sheets

(52) U.S. Cl.
CPC ..... *G03G 2221/166* (2013.01); *G03G 2221/1823* (2013.01)

(58) Field of Classification Search
USPC ..... 399/90
See application file for complete search history.

(56) References Cited

FOREIGN PATENT DOCUMENTS

| | | | |
|---|---|---|---|
| CN | 203405672 | U | 1/2014 |
| CN | 104808468 | A | 7/2015 |
| CN | 105549361 | A | 5/2016 |
| CN | 205750283 | U | 11/2016 |

* cited by examiner

TONER CARTRIDGE AND DEVELOPING CARTRIDGE FOR IMAGE FORMING APPARATUS, AND IMAGE FORMING APPARATUS

This application is a continuation application of International Application No. PCT/CN2016/109326, filed on Dec. 9, 2016, which claims priority of Chinese Patent Application No. 201521124702.7, filed on Dec. 31, 2015. The entire contents of above enumerated patent applications are incorporated herein by reference.

TECHNICAL FIELD

The present disclosure relates to a field of image forming technology and, in particular, to a toner cartridge for an image forming apparatus, a developing cartridge including the toner cartridge, and the image forming apparatus including the toner cartridge.

BACKGROUND

A printer or an image forming apparatus with a printing function is a common office apparatus and gradually becomes a common home electronic apparatus. Usually, in a conventional laser printer, an image is formed on a recording medium using a detachable developing cartridge. The developing cartridge is mounted to the printer during normal operation. The developing cartridge includes a storage member, which includes a storage unit. The storage unit can be configured to store information such as the model number, the capacity, or the applied area, etc. of the developing cartridge. A main body of the printer includes contacting members which are configured to be connected to the storage member of the developing cartridge. For example, a plurality of springs may be disposed on the main body of the printer and configured to be connected to a plurality of contacts on the storage member of the developing cartridge. Therefore, the electrical connection and information communication between the printer and the storage member of the developing cartridge can be realized. In this case, the printer can obtain or rewrite the information stored in the storage member of the developing cartridge.

SUMMARY

The present disclosure provides a toner cartridge for an image forming apparatus, the toner cartridge including a housing, the housing including a toner chamber configured therein to store toner, and a developing roller disposed at a rear side of the housing. The toner cartridge further includes a storage member disposed on a lower surface of the housing and configured to store information of the toner cartridge; and with respect to the rear side of the housing for disposing the developing roller, the storage member being located closer to a front side of the housing opposite to the rear side.

In one embodiment, the toner cartridge further includes: a pressing element extending from a left side or right side wall of the toner cartridge; and after the toner cartridge is mounted to the image forming apparatus, the pressing element receives a first force from the image forming apparatus, the storage member receives a second force from the image forming apparatus and a direction of the first force is opposite to a direction of the second force.

In one embodiment, in the toner cartridge, two rows of contacts are disposed on the storage member, a first row of contacts disposed close to the developing roller including a voltage common collector (VCC) contact and a ground (GND) contact, a second row of contacts including a plurality of signal contacts; the image forming apparatus includes a main body, the main body including contacting members configured to be respectively connected to the VCC contact, the GND contact and the signal contacts; and in a process of mounting the toner cartridge to the image forming apparatus, the GND contact is connected to a corresponding contacting member in the main body earlier than the VCC contact being connected to a corresponding contacting member in the main body; and the VCC contact is connected to the corresponding contacting member in the main body earlier than the signal contacts being connected to corresponding contacting members in the main body.

In one embodiment, in the toner cartridge, two rows of contacts are disposed on the storage member, a first row of contacts disposed close to the developing roller including a VCC contact and a GND contact, a second row of contacts including a plurality of signal contacts; the image forming apparatus includes a main body, the main body including contacting members configured to be respectively connected to the VCC contact, the GND contact and the signal contacts; and in a process of removing the toner cartridge from the image forming apparatus, the signal contacts are disconnected from corresponding contacting member in the main body earlier than the VCC contact being disconnected from a corresponding contacting member in the main body; and the VCC contact is disconnected from the corresponding contacting member in the main body earlier than the GND contact being disconnected from a corresponding contacting member in the main body.

The present disclosure also provides a developing cartridge for the image forming apparatus, a drum assembly configured to support a photosensitive drum, and the developing cartridge also includes any toner cartridge described above.

In one embodiment, in the developing cartridge, a storage member is disposed on an upper surface of the drum assembly and configured to store information of the drum assembly.

In one embodiment, in the developing cartridge, the drum assembly includes a row of contacts of the storage member; and the storage member is located at a position close to a rear side of a frame of the drum assembly.

In one embodiment, in the developing cartridge, a waste toner outlet for discharging waste toner is disposed at a right side of the drum assembly, and the storage member is located on an upper surface and close to a left side of the frame of the drum assembly.

In one embodiment, in the developing cartridge, d1 is a center-to-center distance of abutment areas between contacts on the storage member and the contacting members on a printer; d2 is a distance between centers of abutment areas of the contacts in the first row on the storage member with the contacting members on the printer and centers of abutment areas of the contacts in the second row on the storage member with the contacting members on the printer; d3 is a center-to center distance of abutment areas between the contacts in the first row on the storage member with the contacting members on the printer; and d1>d2 and d1>d3.

The present disclosure also provides an image forming apparatus, the image forming apparatus including a main body for mounting a toner cartridge or a developing cartridge, the main body including contacting members configured to be connected to contacts of a storage member of the toner cartridge or the developing cartridge; the image forming apparatus further includes any toner cartridge or developing cartridge described above.

In the present disclosure, the storage member of the developing cartridge is disposed at a position away from the waste toner outlet, which can solve a technical defect of conventional technologies that the storage member of the developing cartridge is close to the developing roller and easy to be contaminated, causing a weak connection between the storage member of the developing cartridge and the main body.

In the present disclosure, the GND contact is connected to a corresponding contacting member in the main body earlier than the VCC contact being connected to a corresponding contacting member in the main body, which can solve a technical defect of conventional technologies that it is easy to form a high voltage on the contacts of the storage member, causing damage of elements of the storage member due to discharging of the high voltage.

In the present disclosure, the VCC contact is connected to the corresponding contacting member in the main body earlier than the signal contacts being connected to a corresponding contacting members in the main body, which can solve a technical defect that there is not a certain sequence for a plurality of contacts on the storage member to be connected to a plurality of corresponding contacting members on the main body of the printer, causing a poor stability of the storage member of the developing cartridge.

The characteristics and advantages are set forth in the following specification, and, part of them are evident through the specification, or understood through implementing the technical solutions of the present disclosure. The objects and other advantages of the present disclosure can be achieved and obtained through structures and/or procedures specified in the specification, claims and the accompany drawings.

DETAILED DESCRIPTION

The following describes some embodiments of the present disclosure with reference to the accompanying drawings. The embodiments described herein are only used for illustrating and explaining the present disclosure, and not intended to limit the present disclosure. In cases of no conflict, features in some embodiments of the present disclosure can be combined with each other.

In conventional printers, an electrical connection between a main body of a printer and a storage member of a developing cartridge is often not stable and reliable.

The storage member of the developing cartridge usually includes a ground (GND) contact, a voltage common collector (VCC) contact, and a plurality of signal contacts. The main body of the printer also includes a GND contacting member, a VCC contacting member, and a plurality of signal contacting members.

During a normal operation of the printer, it is possible that vibration and impact can weaken the connection between the storage member of the developing cartridge and the main body of the printer. When the VCC contact of the storage member of the developing cartridge is well connected to the VCC contacting member of the main body of the printer, but the GND contact of the storage member of the developing cartridge is disconnected from the GND contacting member of the storage member of the developing cartridge, it is also possible that the voltage on the contacts of the storage member of the developing cartridge is not stable and a high voltage can be formed on the contacts of the storage member, causing damage of elements of the storage member due to discharging of the high voltage.

In addition, in the conventional printers, when the developing cartridge is mounted to the printer or the developing cartridge is removed from the printer, there is not a certain sequence for each of the contacts on the storage member of the developing cartridge to be connected to or disconnected from each of the corresponding contacting members on the main body of the printer, causing a poor stability of the storage member of the developing cartridge.

Figure 1:
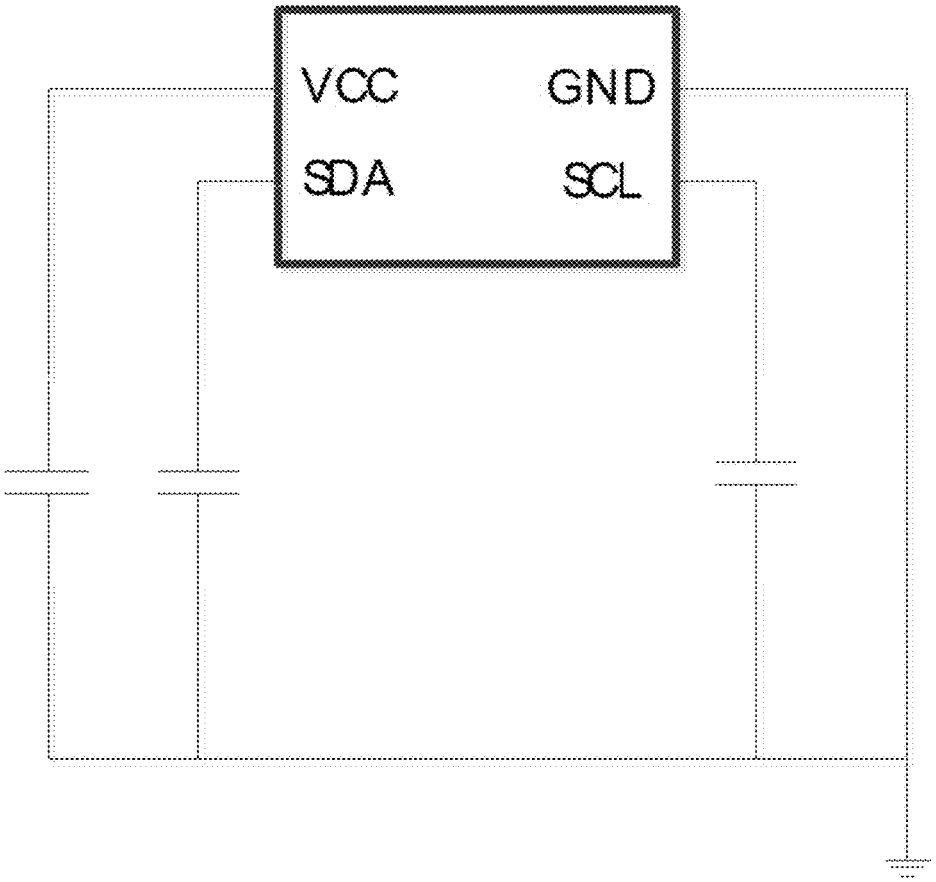
FIG. 1 is a schematic diagram of an external circuit of a storage member when the storage member of a developing cartridge in a conventional printer is operating.

FIG. 1 is a schematic diagram of an external circuit of a storage member when the storage member of a developing cartridge in a conventional printer is operating. The storage member may include a VCC contact, a GND contact, and a plurality of signal contacts including a signal of data (SDA) contact and a signal of clock (SCL) contact. During a normal operation, an electric current can be formed between the VCC contact and the signal contacts (the SDA contact and the SCL contact) by a plurality of electronic elements (e.g. capacitors, resistors, and transistors, etc.) in the storage member. The electric current flows from the VCC contact, through the plurality of electronic elements in the storage member, to the SDA contact and the SCL contact. However, during the process of mounting the developing cartridge to the printer, if the signal contacts (the SDA contact and the SCL contact) on the storage member are connected to signal contacting members of the main body of the printer earlier than the VCC contact being connected to the VCC contacting member of the main body of the printer, it is possible that a reverse electric current is formed between the VCC contact and the signal contacts (the SDA contact and the SCL contact). The reverse electric current is an electric current flowing from the SDA contact and the SCL contact, through the plurality of electronic elements in the storage member, to the VCC contact. The reverse electric current may affect the lifetime of the elements of the storage member, damage the elements and affect the operation stability of the storage member. During the process of removing the developing cartridge from the printer, if the VCC contact on the storage member is disconnected from VCC contacting member of the main body of the printer earlier than the signal contacts (the SDA contact and the SCL contact) being disconnected from the signal contacting members of the main body of the printer, a similar problem may also occur, affecting the operation stability of the storage member.

In addition, in the developing cartridge of the conventional printer, the storage member of the developing cartridge is usually disposed close to the developing roller. Therefore, during the image forming process, toner on the developing roller surface may be easily splashed onto the storage member of the developing cartridge, contaminating the storage member of the developing cartridge, which may result in a weak connection between the storage member of the developing cartridge and the main body of the printer.

To solve the above technical problems, the present disclosure provides a toner cartridge for an image forming apparatus, a developing cartridge including the toner cartridge, and the image forming apparatus. The toner cartridge includes a housing, the housing includes a toner chamber configured to store toner, and a developing roller is disposed at a rear side of the housing. The toner cartridge also includes a storage member disposed on a lower surface of the housing and configured to store information of the toner cartridge; and with respect to the rear side of the housing for disposing the developing roller, the storage member is located closer to a front side of the housing opposite to the rear side.

First Exemplary Embodiment

Figure 2:
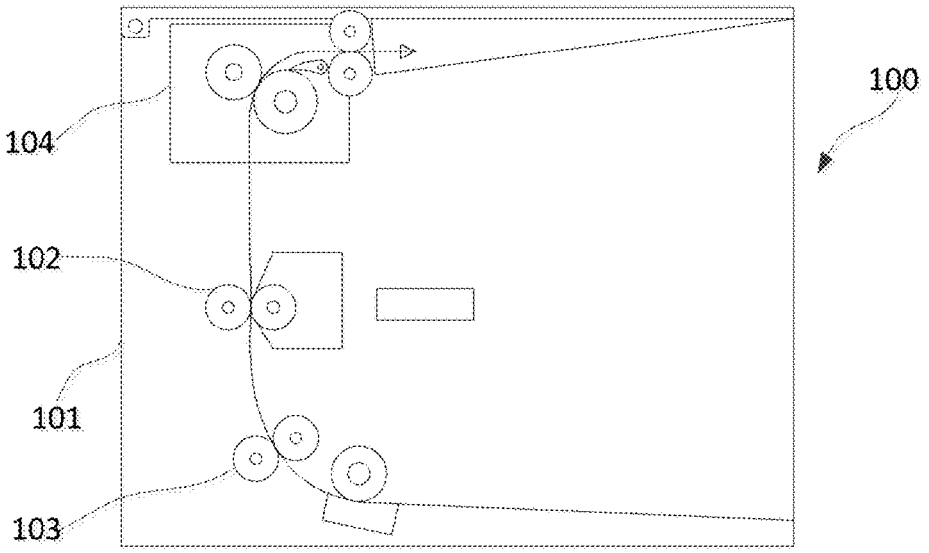
FIG. 2 is a schematic diagram of an overall structure of an image forming apparatus according to a first exemplary embodiment of the present disclosure.

FIG. 2 is a schematic diagram of an overall structure of an image forming apparatus according to a first exemplary embodiment of the present disclosure. The image forming apparatus 100 may include a main body 101 of the image forming apparatus, a developing cartridge 102, a paper conveyor roller 103 and a fusing assembly 104. The developing cartridge 102 may be configured to form an image and transfer the image on to a recording medium. The developing cartridge 102 can be detachably mounted to the image forming apparatus, and may include a storage member, which can be configured to record information of the developing cartridge and control parameters for forming the image. The main body 101 of the image forming apparatus can communicate with the developing cartridge 102 through an electrical connection with the storage member of the developing cartridge 102. For example, the main body 101 of the image forming apparatus can read the information of the developing cartridge and the control parameters from the storage member, or write usage information of the developing cartridge 102 into the storage member. The paper conveyor roller 103 may be configured to convey the recording medium, e.g. convey printing paper. The fusing assembly 104 may be configured to, after the image is transferred by the developing cartridge onto the recording medium, fuse the image on the recording medium.

Figure 3:
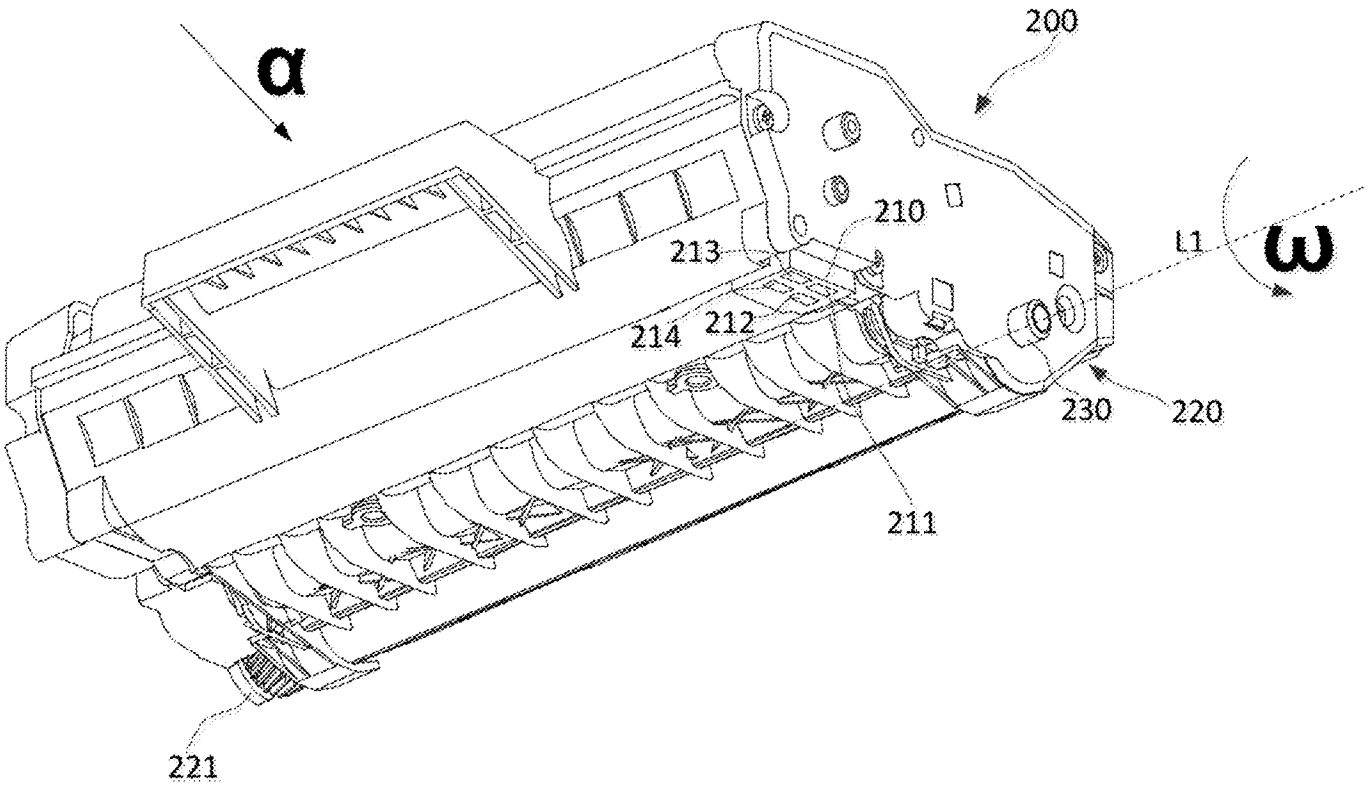
FIG. 3 is a schematic structural view of a developing cartridge according to a first exemplary embodiment of the present disclosure.

FIG. 3 shows a schematic structural view of a developing cartridge according to a first exemplary embodiment of the present disclosure. The developing cartridge 200 may include a storage member 210 and a photosensitive drum 220. The storage member 210 may include a plurality of contacts 211 to 214. A transmission gear 221 may be disposed at one end of the photosensitive drum 220 and configured to receive a driving force transmitted by a driving gear of a main body of the image forming apparatus, so as to drive the photosensitive drum to rotate. When the developing cartridge 200 is mounted to the image forming apparatus, the plurality of contacts 211 to 214 may be connected to corresponding contacting members of a main body of the image forming apparatus, so as to realize an electrical connection between the main body of the image forming apparatus and the storage member of the developing cartridge. The contacting members in the main body of the image forming apparatus may be conductive elements, including conductive cylinders, conductive sheets, springs, elastic sheets, and tension springs, etc. In a first exemplary embodiment of the present disclosure, the contacting members are spring and are refereed as contact springs.

During a normal operation of the developing cartridge, the transmission gear 221 can receive the driving force transmitted by the driving gear of the main body of the image forming apparatus and rotate, inevitably causing vibrations of the developing cartridge and vibrations of the storage member of the developing cartridge. In the first exemplary embodiment of the present disclosure, the storage member 210 may be mounted at one end of the developing cartridge 200 distal to the transmission gear 221 of the photosensitive drum. Therefore, the vibration of the storage member during the transmission process of the driving force can be reduced, resulting in a minimum effect on the electrical connection between each of the contacts on the storage member of the developing cartridge and each of the contacting members on the main body of the image forming apparatus during the transmission process of the driving force.

Figure 4:
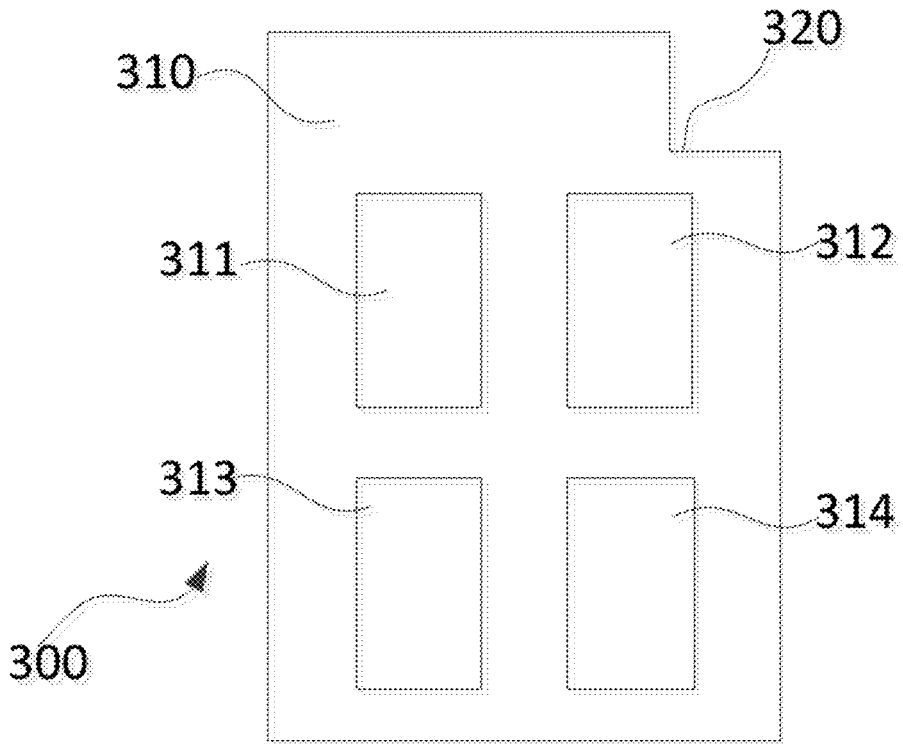
FIG. 4 is a schematic plan view of a storage member of a developing cartridge according to a first exemplary embodiment of the present disclosure.

FIG. 4 shows a schematic plan view of a storage member of a developing cartridge. The storage member 300 may include a storage member base plate 310. The storage member base plate 310 may include a positioning notch 320 for positioning and a plurality of contacts. The plurality of contact may be arranged in two rows. When the storage member is mounted to the developing cartridge, a row of contacts near an axis of the photosensitive drum on the developing cartridge may be electric contacts, which include a GND contact 311 and a VCC contact 312; while the other row of contacts away from the axis of the photosensitive drum on the developing cartridge may be signal contacts, which include a signal contact 313 and another signal contact 314. According to the first exemplary embodiment of the present disclosure, the quantity of the signal contacts is not limited to two (shown in FIG. 4) and may be one or more than two. A plurality of contact springs may be disposed on the main body of the image forming apparatus, and each of the contact springs can be respectively connected to each of the corresponding contacts described above. The GND contact 311 can be connected to the ground by being connected to the GND contact spring on the main body of the image forming apparatus. The VCC contact 312 can receive voltage provided by the image forming apparatus through being connected to the VCC contact spring on the main body of the image forming apparatus. The image forming apparatus can read information from or write information into the storage member 300 through the signal contact 313 and the signal contact 314 being connected to the two corresponding signal contact springs on the main body of the image forming apparatus. The quantity of the signal contact springs is not limited to two. When the quantity of the signal contacts on the storage member is one or more than two, the quantity of the signal contact springs as the contacting members can be one or more than two according to a first exemplary embodiment of the present disclosure.

As shown in FIG. 3, when the storage member 210 is mounted to the developing cartridge 200, compared to the VCC contact 212 (i.e. the VCC contact 312 in FIG. 4), the GND contact 211 (i.e. the GND contact 311 in FIG. 4) is further away from the transmission gear 221 of the photosensitive drum. Therefore, it can be further reduced that the effect of driving force transmission process on the electrical connection between the GND contact 211 and the GND contacting member on the main body of the image forming apparatus. Compared to the connection between the VCC contact 212 and the VCC contacting member on the main body of the image forming apparatus, it is less possible to break the connection between the GND contact 211 and the GND contacting member on the main body of the image forming apparatus.

Figure 5:
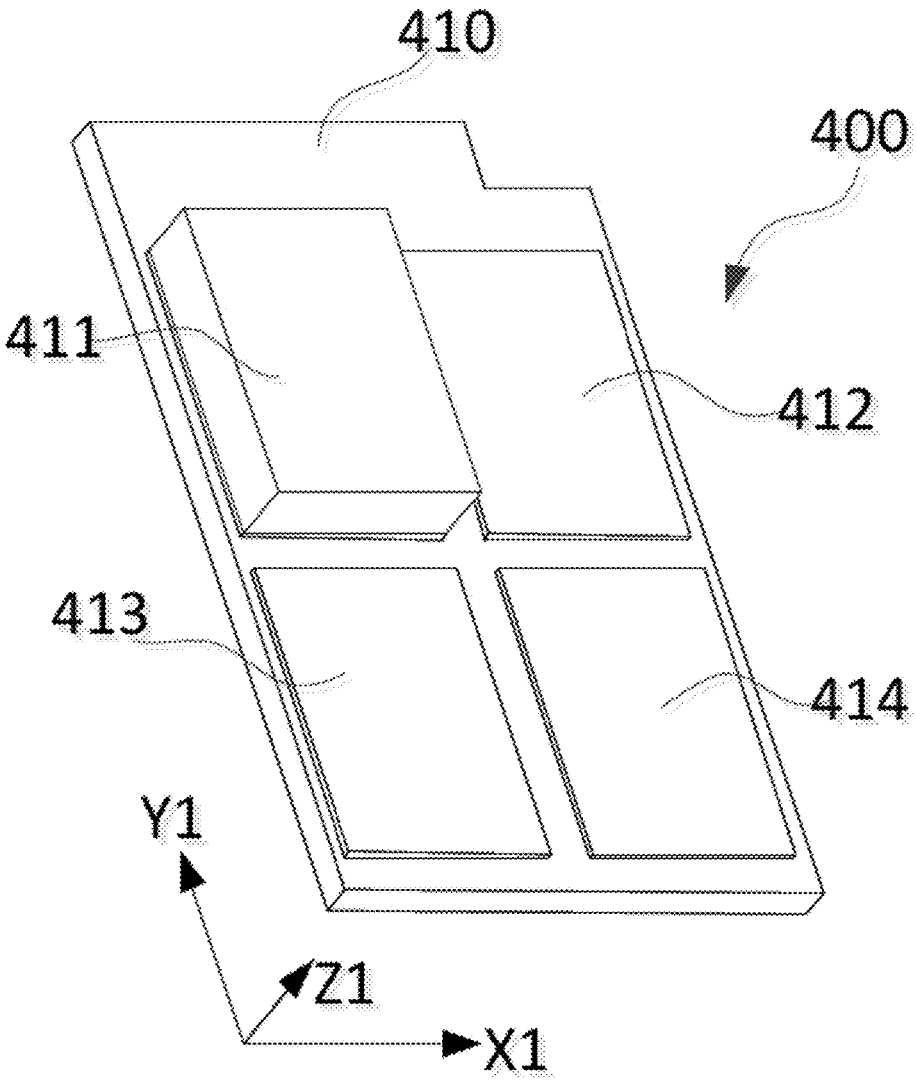
FIG. 5 is a schematic perspective view of a storage member of a developing cartridge according to a first exemplary embodiment of the present disclosure.

FIG. 5 shows a schematic perspective view of a storage member of a developing cartridge, where X1, Y1, and Z1 directions are three axial directions of the storage member in a Cartesian coordinate system. A storage member 400 may include a storage member base plate 410, and a front surface (i.e. a surface facing the main body of the image forming apparatus during a normal operation) of the storage member base plate 410 is in a X1Y1 plane. A plurality of contacts may be disposed on the storage member base plate 410, including a GND contact 411, a VCC contact 412, a signal contact 413 and another signal contact 414, which are the same as the GND contact 311, the VCC contact 312, the signal contact 313 and the signal contact 314, respectively, shown in FIG. 4. Among the plurality of contacts disposed on the storage member base plate 410, a height of a contacting section of the GND contact 411 may be larger than a height of contacting sections of other contacts (the VCC contact 412, the signal contact 413 and the signal contact 414), such that when the plurality of contacts on the storage member base plate 410 are connected to the plurality of contact springs on the main body of the image forming apparatus, compared to the connection between the other contacts and corresponding contact springs, it is more difficult to break the connection between the GND contact 411 and the GND contact spring. Therefore, a reliability of the connection between the GND contact 411 and the GND contact spring can be guaranteed. Optionally, the height of the contacting section of the GND contact 411 may be 2 mm larger than contacting sections of other contacts.

It should be noted that the contacting sections of the contacts on the storage member according to embodiments of the present disclosure may refer to contacting portions between the contacts on the storage member and the contact springs on the main body of the image forming apparatus. Each of the contacting sections can be, but not limited to a flat or curved contacting surface, a contacting point, or a plurality of continuous or discontinuous contacting points.

The height of each contacting section according to a first exemplary embodiment of the present disclosure may refer to a maximum distance from the front surface of the storage member base plate along the direction of Z1 axis to each of the contacting sections (a flat surface, a curved surface, one contacting point or multiple contacting points) between each of the contacts on the storage member and each of the corresponding contact springs on the main body of the image forming apparatus.

Below describes an example about the process of mounting the developing cartridge to the image forming apparatus.

As shown in FIG. 3, a straight line L1 represents the axis of the photosensitive drum 220 as a rotation member on the developing cartridge. During the normal operation of the developing cartridge, the transmission gear 221 may receive the driving force from the driving gear of the main body of the image forming apparatus to rotate around the axis L1. The rotation member may include but is not limited to the photosensitive drum. In some embodiments, the rotation member may be a member including a developing roller, and protrusions disposed at two ends of the developing cartridge, etc.

First, the developing cartridge 200 may be inserted into the image forming apparatus along an a direction as shown in FIG. 3, till the two ends of the developing cartridge 200 are respectively in contact with an accommodating member disposed in the image forming apparatus. That is, when a protrusion 230 on an end cap of one end of the developing cartridge is in contact with a corresponding protruding accommodating member of the main body of the image forming apparatus, and a protrusion (not shown) on an end cap of the other end (the end where the transmission gear 221 is disposed) of the developing cartridge is in contact with a corresponding protruding accommodating member of the main body of the image forming apparatus, the developing cartridge may arrive at a designated mounting position. Then, the mounting process can be completed by rotating the developing cartridge around the axis L1 of the photosensitive drum along a co direction shown in FIG. 3 till each of the plurality of contacts on the storage member 210 of the developing cartridge is connected to each of the plurality of contact springs on the main body of the image forming apparatus.

Figure 6:
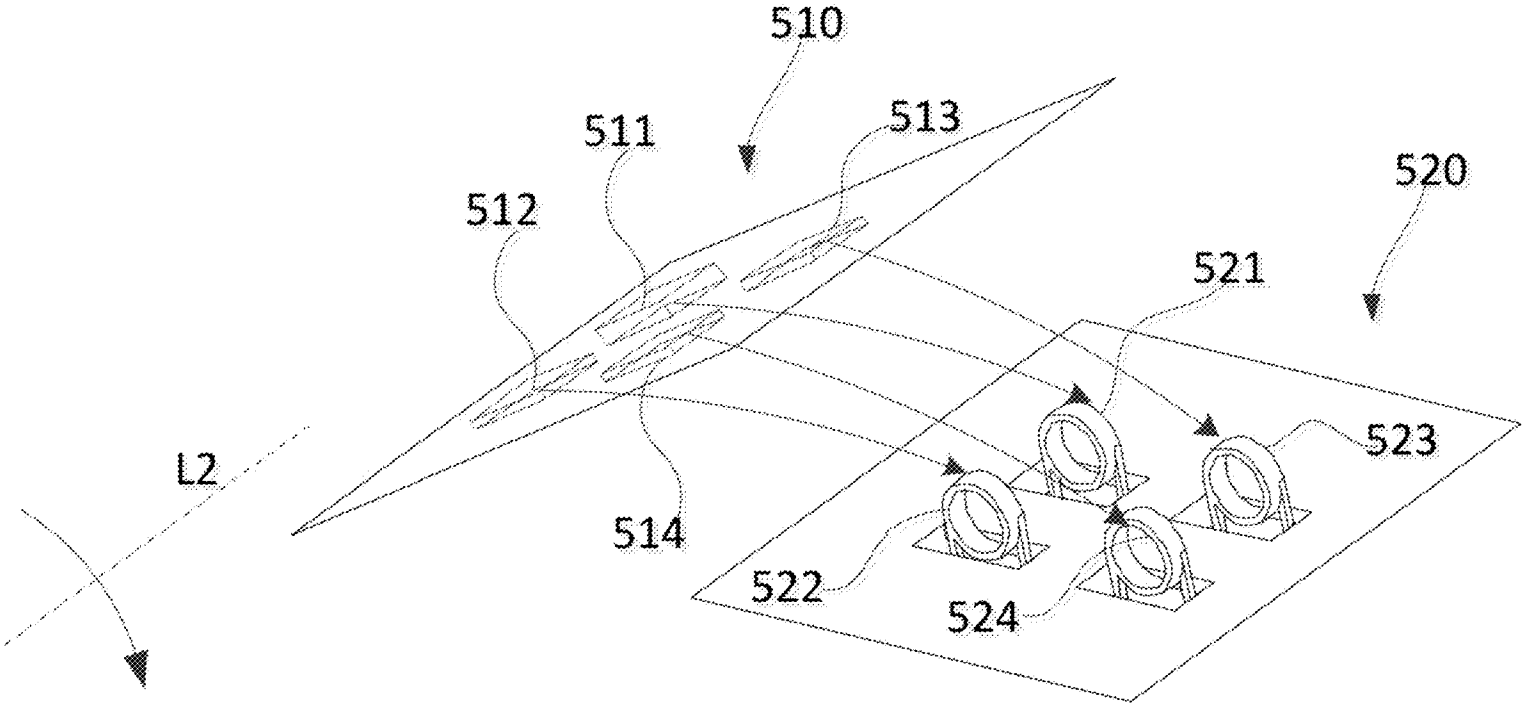
FIG. 6 is a schematic diagram of a sequence for contacts of a storage member to be connected to contact springs of a main body of an image forming apparatus according to a first exemplary embodiment of the present disclosure.

FIG. 6 shows a schematic diagram of a sequence for each contact on the storage member to be connected to each contact spring on the main body of the image forming apparatus. As shown in FIG. 6, a storage member 510 may include a GND contact 511, a VCC contact 512, a signal contact 513 and another signal contact 514. The main body 520 of the image forming apparatus may include a GND contact spring 521, a VCC contact spring 522, a signal contact spring 523 and another signal contact spring 524. A straight line L2 may represent an axis of a photosensitive drum as a rotation member on the developing cartridge.

Among the plurality of contacts on the storage member 510, compared to the signal contact 513 and the signal contact 514, the GND contact 511 and the VCC contact 512 are closer to the axis L2 of the photosensitive drum. Therefore, when the developing cartridge is rotated around the axis L2 along the co direction as shown in FIG. 6, earlier than the signal contact 513 and the signal contact 514 being connected to corresponding signal contact springs, the GND contact 511 and the VCC contact 512 on the storage member 510 can be connected to the GND contact spring 521 and the VCC contact spring 522, respectively on the main body 520 of the image forming apparatus. Also, among the plurality of contacts on the storage member 510, a height of a contacting section of the GND contact 511 may be larger than the height of contacting sections of other contacts. Therefore, when the developing cartridge is rotated around the axis L2, the GND contact 511 on the storage member 510 can be connected to the GND contact spring on the main body of the image forming apparatus earlier than the VCC contact 512 being connected to the corresponding contact spring.

That is, during the mounting process of the developing cartridge, among the plurality of the contacts on the storage member 510, the GND contact 511 may be connected to the GND contact spring 521 on the main body 520 of the image forming apparatus first, and after a certain time t1 (t1 may be very small but exists, and t1>0), the VCC contact 512 on the storage member 510 can be connected to the VCC contact spring 522 on the main body 520 of the image forming apparatus. After another certain time t2 (t2 may be very small but exists, t2 may be the same as or different from t1, and t2>0), the signal contact 513 and the signal contact 514 on the storage member 510 can be connected to the contact spring 523 and the contact spring 524, respectively on the main body 520 of the image forming apparatus. Therefore, it is possible to prevent the problem that elements on the storage members are damaged due to discharging of a high voltage, which is formed on the contacts of the storage member earlier than the GND contact 511 on the storage member of the developing cartridge being connected to the ground. Further, it is also possible to prevent the problem that the operation stability of the storage member may be affected by a large reversed electric current between the contacts of the storage member, which is formed because the signal contact 513 and the signal contact 514 are connected to the corresponding signal contact springs on the main body of the image forming apparatus earlier than VCC contact 512 being connected to the VCC contact spring.

It should be easy for those skilled in the art to understand that when the developing cartridge is removed from the image forming apparatus, a sequence for disconnecting each of the plurality of contacts on the storage member of the developing cartridge from each of the corresponding contact springs on the main body of the image forming apparatus may be opposite to the connecting sequence during the mounting process of the developing cartridge. That is, first the signal contacts may be disconnected from the corresponding signal contact springs on the main body of the image forming apparatus; then the VCC contact on the storage member may be disconnected from the VCC contact spring on the main body of the image forming apparatus; and last the GND contact on the storage member may be disconnected from the GND contact spring on the main body of the image forming apparatus. Therefore, it is possible to prevent the problem that elements on the storage members are damaged due to discharging of a high voltage, which is formed on the contacts of the storage member during the process of removing developing cartridge from the image forming apparatus. Further, it is also possible to prevent the problem that the operation stability of the storage member may be affected by a large reversed electric current formed between the contacts of the storage member.

Second Exemplary Embodiment

Figure 7:
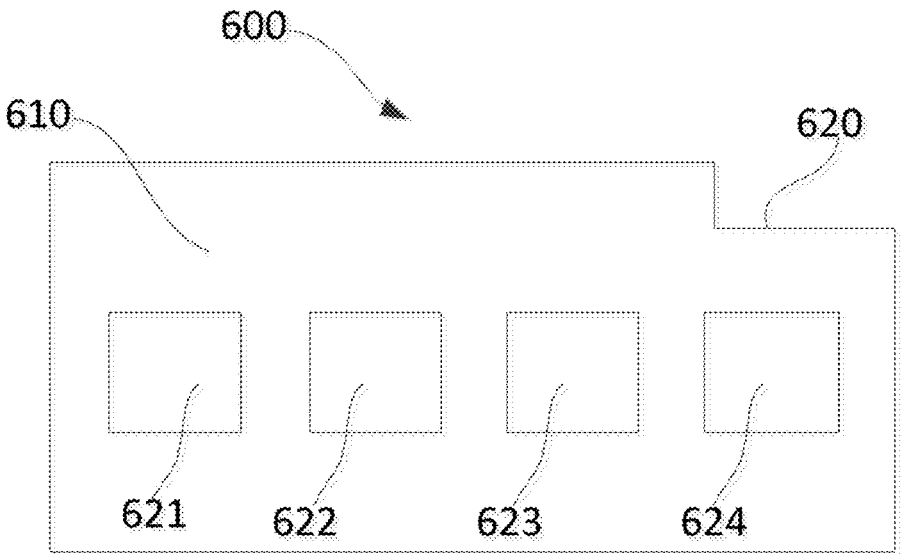
FIG. 7 is a schematic plan view of a storage member of a developing cartridge according to a second exemplary embodiment of the present disclosure.

As shown in FIG. 7, the storage member 600 according to a second exemplary embodiment of the present disclosure may include a storage member base plate 610. The storage member base plate 610 may include a positioning notch 620 for positioning and a plurality of contacts. Different from the first exemplary embodiment, the plurality of contacts on the storage member base plate may be arranged as one row parallel to an axis of the photosensitive drum. The plurality of contacts may include a GND contact 621, a VCC contact 622, a signal contact 623 and another signal contact 624. The quantity of signal contacts according to embodiments of the present disclosure may include but is not limited to two (shown in FIG. 7) and can be one or greater than two.

Figure 8:
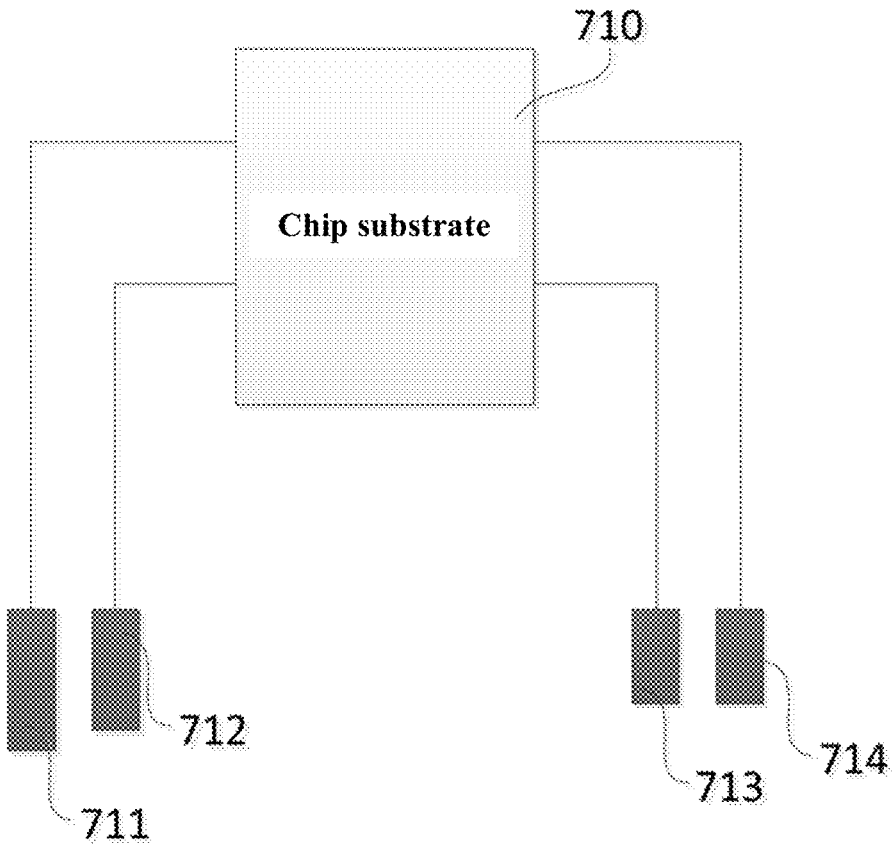
FIG. 8 is a schematic diagram of a method for arranging contacts on a storage member according to a second exemplary embodiment of the present disclosure.

FIG. 8 shows schematic diagram of a method for arranging contacts of a storage member according to the second exemplary embodiment of the present disclosure. As shown in FIG. 8, the storage member base plate may be a chip substrate 710. The chip substrate 710 may be a printed circuit board (PCB) and include a GND contact 711, a VCC contact 7112, a signal contact 713 and another signal contact 714. A height of a contacting section of the GND contact 711 may be larger than the height of contacting sections of other contacts. The height of the contacting section of VCC contact 712 is smaller than the height of the contacting section of the GND contact 711 but larger than the height of the contacting sections of the signal contact 713 and the signal contact 714. Optionally, the height of the contacting section of the GND contact 711 according to the second exemplary embodiment may be 1 mm larger than the height of the contacting section of the VCC contact 712. The height of the contacting section of the VCC contact 712 may be 1 mm larger than the height of the contacting sections of the signal contact 713 and the signal contact 714.

It should be noted that the contacting sections of the contacts on the storage member according to the second exemplary embodiment of the present embodiment may refer to contacting portions between the contacts on the storage member and the corresponding contact springs on the main body of the image forming apparatus. Each of the contacting sections can be, but not limited to a flat or curved contacting surface, a contacting point, or a plurality of continuous or discontinuous contacting points.

The meaning of the height of each contacting section in the second exemplary embodiment is the same as that in the first exemplary embodiment.

Therefore, in the process of mounting the developing cartridge to the image forming apparatus by rotating the developing cartridge around the photosensitive drum axis, the GND contact on the storage member may be first connected to the GND contacting member on the main body of the image forming apparatus, and then the VCC contact on the storage member may be connected to the VCC contacting member on the image forming apparatus maim body, and finally the signal contacts on the storage member may be connected to the signal contacting members on the main body of the image forming apparatus. The contacting members in the main body of the image forming apparatus may be conductive elements, including conductive cylinders conductive sheets, springs, elastic sheets, and tension springs, etc. According to the second exemplary embodiment of the present disclosure, the contacting members in the main body of the image forming apparatus are springs. The quantity of the signal contacting members is not limited to two. When the quantity of the signal contacts on the storage member is one or more than two, the quantity of the signal contact springs as the contacting members can be one or more than two according to the second exemplary embodiment of the present disclosure.

In addition, the height of the contacting section of the GND contact 711 is larger than the height of contacting section of the other contacts, so that the reliability of the connection between the GND contact 711 and the GND contact spring of the main body of the image forming apparatus can be ensured.

Third Exemplary Embodiment

Figure 9:
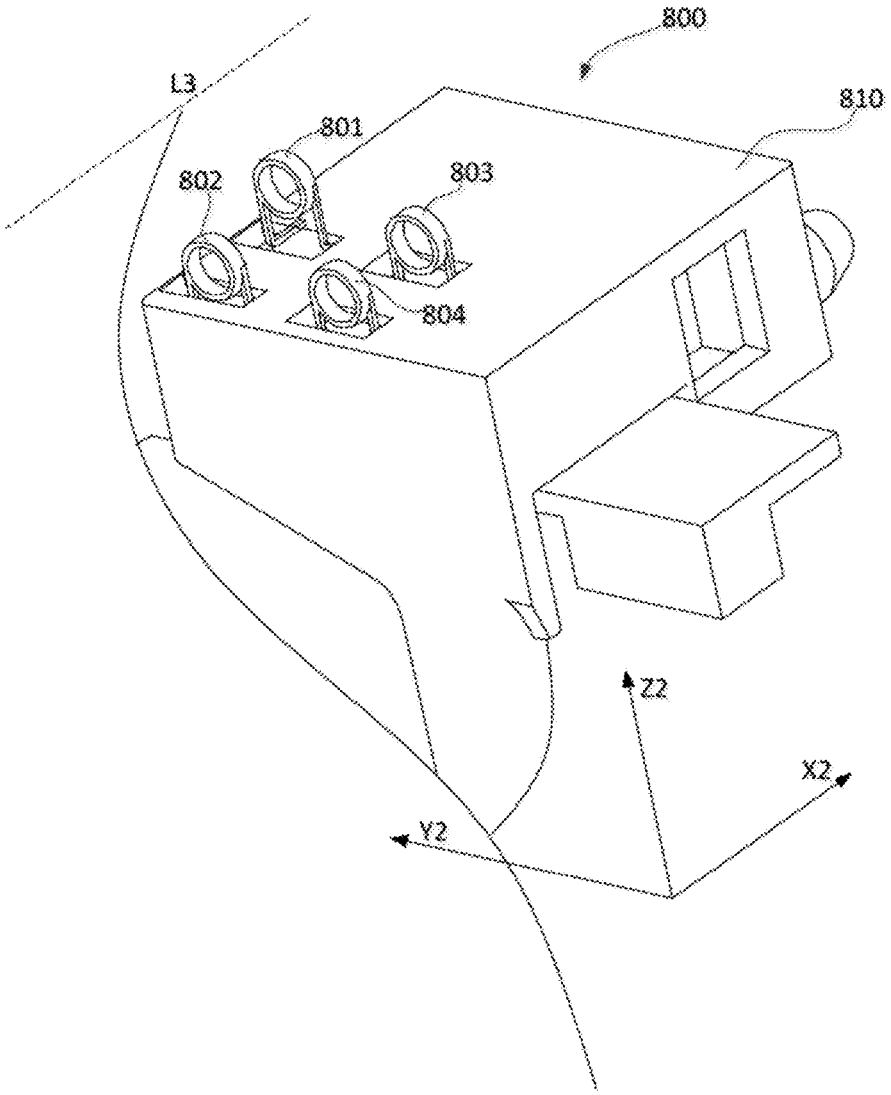
FIG. 9 is a partial schematic view of a main body of an image forming apparatus according to a third exemplary embodiment of the present disclosure.

FIG. 9 is a partial schematic view of a main body of the image forming apparatus according to a third exemplary embodiment. As shown in FIG. 9, a straight line L3 represents an axis of the photosensitive drum as a rotation member in the developing cartridge when the mounting process of the developing cartridge into the image forming apparatus is completed. The rotation member may include but is not limited to the photosensitive drum. In some embodiments, the rotation member may be a member including a developing roller, and protrusions disposed at two ends of the developing cartridge, etc. X2, Y2, and Z2 directions in FIG. 9 represent three axial directions of the main body of the image forming apparatus in a Cartesian coordinate system.

The main body 800 of the image forming apparatus may include a plurality of contacting members configured to be connected to the contacts on the storage member of the developing cartridge, and the plurality of contacting members can be arranged in two rows. The contacting members on the main body of the image forming apparatus may be conductive elements, including conductive cylinders, conductive sheets, springs, elastic sheets, and tension springs, etc. According to the third exemplary embodiment of the present disclosure, the contacting members in the main body of the image forming apparatus are springs (referred as contact springs). Among the plurality of contact springs, the GND contact spring 801 and the VCC contact spring 802 may be disposed in a row near L3, while the signal contact spring 803 and the signal contact spring 804 may be disposed in the other row away from L3. The quantity of signal contact springs on the main body of the image forming apparatus according to the third exemplary embodiment of the present disclosure is not limited to two (shown in FIG. 9) and may be one or more than two.

A plane 810 in FIG. 9 may refer to a mounting plane of the plurality of contact springs to the main body of the image forming apparatus, and the plane 810 may be in a X2Y2 plane.

According to the third exemplary embodiment, a height of a contacting section of the GND contact spring 801 may be larger than the height of contacting sections of other contact springs (the VCC contact spring 802, the signal contact spring 803 and the signal contact spring 804), Optionally, the height of the contacting section of the GND contact spring 801 may be 2 mm larger than the height of the contacting sections of other contact springs.

It should be noted that the contacting sections of the contact springs according to the third exemplary embodiment of the present disclosure may refer to contacting portions between the contact springs on the main body of the image forming apparatus and the contacts on the storage member. Each of the contacting sections can be, but not limited to a flat or curved contacting surface, a contacting point, or a plurality of continuous or discontinuous contacting points.

The height of each of the contacting sections according to the third exemplary embodiment of the present disclosure may refer to a maximum distance from the plane 810 along the direction of Z2 axis to the contacting section (a flat surface, a curved surface, a contact point or multiple contact points) between each of the contact springs on the main body of the image forming apparatus and each of the corresponding contacts on the storage member of the developing cartridge.

Among the plurality of contact springs on the main body of the image forming apparatus, compared to the signal contact spring 803 and the signal contact spring 804, the GND contact spring 801 and the VCC contact spring 802 are closer to the axis L3 of the developing cartridge. Therefore, in the process of mounting the developing cartridge to the image forming apparatus by rotating the developing cartridge around the axis of the photosensitive drum, the GND contact spring 801 and the VCC contact spring 802 can be connected to the GND contact and the VCC contact, respectively on the storage member of the developing cartridge, earlier than the signal contact spring 803 and the signal contact spring 804 being connected to corresponding contacts on the storage member. Further, the height of the contacting section of the GND contact spring 801 is larger than the height of the contacting sections of other contact springs. Therefore, in the process of mounting the developing cartridge to the image forming apparatus by rotating the developing cartridge around the axis of the photosensitive drum, the GND contact spring 801 can be connected to the GND contact on the storage member of the developing cartridge, earlier than the VCC contact spring being connected to the corresponding VCC contact om the storage member.

That is, during the mounting process of the developing cartridge, among the plurality of the contacts on the main body of the image forming apparatus, the GND contact spring may be first connected to the GND contact on the storage member, then the VCC contact spring on the main body of the image forming apparatus may be connected to the VCC contact on the storage member, and finally the signal contact spring on the main body of the image forming apparatus may be connected to the signal contacts on the storage member. The quantity of the signal contacts on the storage member may include but is not limited to two. When the quantity of the signal contact springs on the main body of the image forming apparatus is one or more than two, the quantity of the signal contacts on the storage member can be one or more than two according to the third exemplary embodiment of the present disclosure.

In addition, the height of the contacting section of the GND contact spring 801 is larger than the height of the contacting sections of the other contacts, so that the reliability of the connection between the GND contact spring 801 and the GND contact on the storage member of the developing cartridge can be ensured.

Exemplary Embodiment IV

Figure 10:
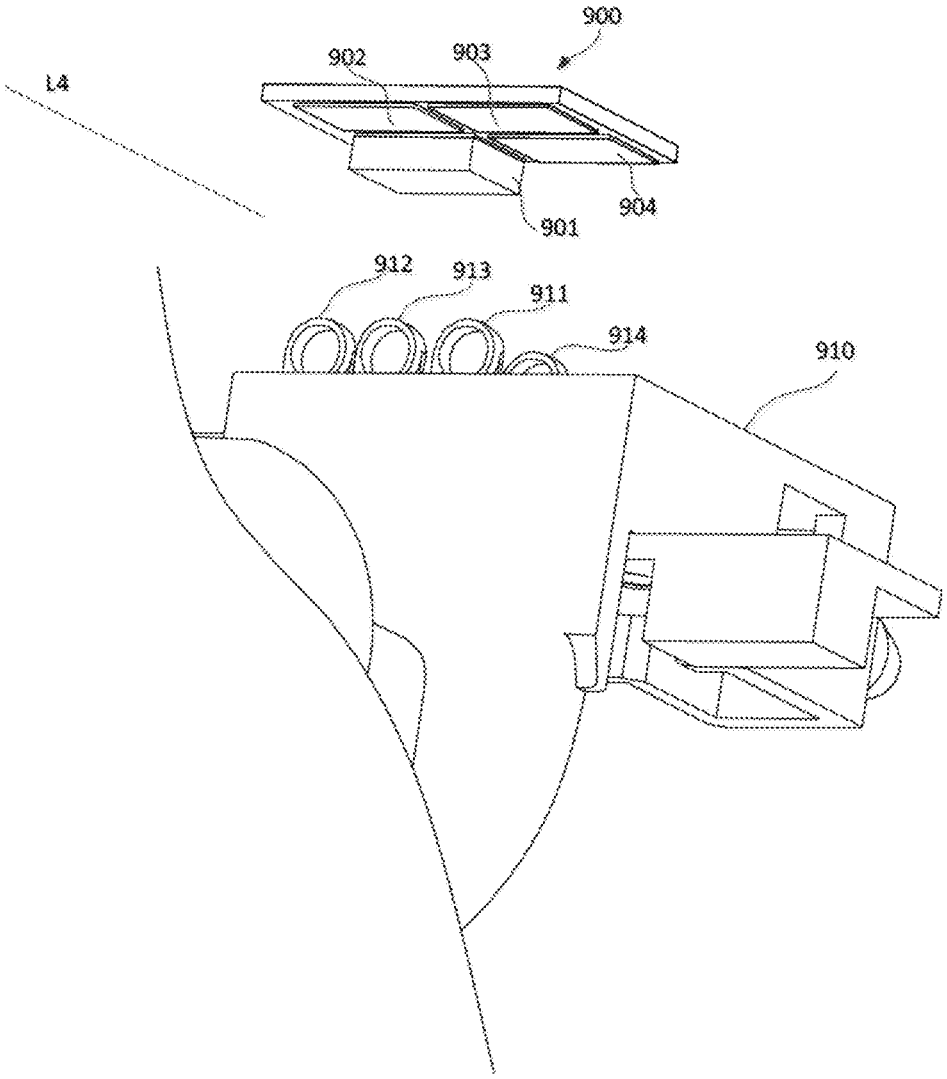
FIG. 10 is a schematic view illustrating a cooperation relationship between contacts on a storage member of a developing cartridge and contact springs on a main body of an image forming apparatus according to a fourth exemplary embodiment of the present disclosure.

FIG. 10 is a schematic view illustrating a cooperation relationship between each contact on a storage member of a developing cartridge and each contact spring on a main body of the image forming apparatus according to a fourth exemplary embodiment of the present disclosure. As shown in FIG. 10, a straight line L4 represents an axis of the photosensitive drum as a rotation member in the developing cartridge when the mounting process of the developing cartridge to the image forming apparatus is completed. The rotation member may include but is not limited to the photosensitive drum. In some embodiments, the rotation member may be a member including a developing roller, and protrusions disposed at two ends of the developing cartridge, etc.

In the fourth exemplary embodiment, the storage member 900 may include a plurality of contacts arranged as two rows. The plurality of contacts may include a GND contact 901, a VCC contact 902, a signal contact 903 and another signal contact 904. The quantity of signal contacts according to embodiments of the present disclosure may include but is not limited to two (shown in FIG. 10) and can be one or greater than two. Among the plurality of contact springs, the GND contact 901 and the VCC contact 902 may be disposed in a row near L4, while the signal contact 903 and the signal contact 904 may be disposed in the other row away from L4.

Also, among the plurality of contacts, a height of a contacting section of the GND contact 901 may be larger than the height of contacting sections of other contacts (the VCC contact 902, the signal contact 903 and the signal contact 904). Optionally, the height of the contacting section of the GND contact 901 may be 1 mm larger than the height of the contacting sections of other contacts.

The meaning of the height of the contacting section of each contact in the fourth exemplary embodiment is the same as that in the first exemplary embodiment.

The main body 910 of the image forming apparatus may include a plurality of contacting members arranged in two rows corresponding to the plurality of contacts on the storage member 900. The plurality of contacting members may include a GND contacting member 911, a VCC contacting member 912, a signal contacting member 913 and another signal contacting member 914. The contacting members may be conductive elements, including conductive cylinders, conductive sheets, springs, elastic sheets, and tension springs, etc. According to the fourth embodiment of the present disclosure, the contacting members are springs (referred as contact springs). The quantity of signal contact springs may include but, is not limited to two (shown in FIG. 10). When the quantity of the signal contacts on the storage member is one or more than two, the quantity of the signal contact springs on the main body of the image forming apparatus can be one or more than two according to the fourth exemplary embodiment of the present disclosure. Among the plurality of contact springs, the GND contact spring 911 and the VCC contact spring 912 may be disposed near L4, while the signal contact spring 913 and the signal contact spring 914 may be disposed away from L3.

Also, among the plurality of contact springs, a height of a contacting section of the GND contact spring 911 may be larger than the height of contacting sections of other contact springs (the VCC contact spring 912, the signal contact spring 913 and the signal contact spring 914). Optionally, the height of the contacting section of the GND contact spring 911 may be 1 mm larger than the height of the contacting sections of other contact springs.

The meaning of the height of the contacting section of each of the contact springs in the fourth exemplary embodiment is the same as that in the third exemplary embodiment.

It should be noted that the contacting sections of the contacts on the storage member according to embodiments of the present embodiment may refer to contacting portions between the contacts on the storage member and the contact springs on the main body of the image forming apparatus. Each of the contacting sections of the contacts can be, but not limited to a flat or curved contacting surface, a contacting point, or a plurality of continuous or discontinuous contacting points.

The contacting sections of the contact springs may refer to contacting portions between the contact springs on the main body of the image forming apparatus and the contacts on the storage member. Each of the contacting sections of the contact springs can be, but not limited to a flat or curved contacting surface, a contacting point, or a plurality of continuous or discontinuous contacting points Those skilled in the art can easily understand that the GND contact and the VCC contact on the storage member are closer to the developing cartridge axis than the signal contacts, and the GND contact spring and the VCC contact spring on the main body of the image forming apparatus are closer to the developing cartridge axis than the signal contact springs, so in the process of mounting developing cartridge into the image forming apparatus by rotating the developing cartridge around the axis of the photosensitive drum, the GND contact and the VCC contact on the storage member may be connected to the GND contact spring and the VCC contact spring on the main body of the image forming apparatus, and then the signal contacts on the storage member may be connected to the signal contact springs on the main body of the image forming apparatus.

Further, among the plurality of contacts on the storage member, the height of the contacting section of the GND contact is larger than the height of the contacting sections of other contacts, and among the plurality of contact springs, the height of the contacting section of the GND contact spring is higher than the height of contacting sections of other contact springs. Therefore, during the process of mounting the developing cartridge into the image forming apparatus by rotating the developing cartridge, the GND contact on the storage member may be connected to the GND contact spring on the main body of the image forming apparatus earlier than the VCC contact on the storage member being connected to the VCC contact spring on the main body of the image forming apparatus.

That is, during the mounting process of the developing cartridge, among the plurality of contacts on the storage member, the GND contact may be first connected to the GND contact spring on the main body of the image forming apparatus, then the VCC contact on the storage member may be connected to the VCC contact spring on the main body of the image forming apparatus, and finally the signal contacts on the storage member may be connected to the signal contact springs on the main body of the image forming apparatus.

In addition, the height of the contacting section of the GND contact is larger than the height of the contacting section of the other contacts on the storage member, and the height of the contacting section of the GND contact spring is larger than the height of the contacting sections of other contact springs on the main body of the image forming apparatus, so that the reliability of the connection between the GND contact on the storage member and the GND contact spring of the main body of the image forming apparatus can be ensured.

Fifth Exemplary Embodiment

Figure 11:
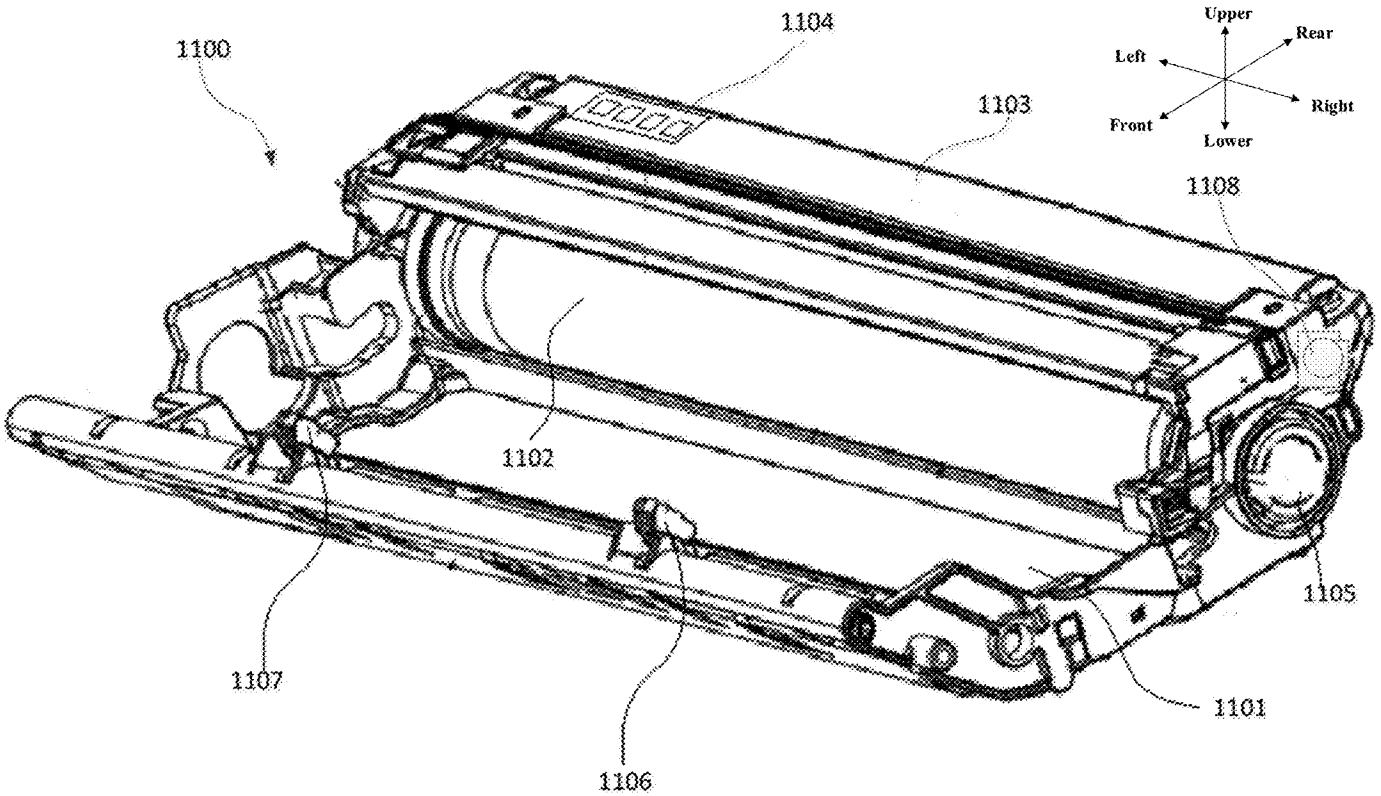
FIG. 11 is a schematic structural diagram of a drum assembly according to a fifth exemplary embodiment of the present disclosure.
Figure 12:
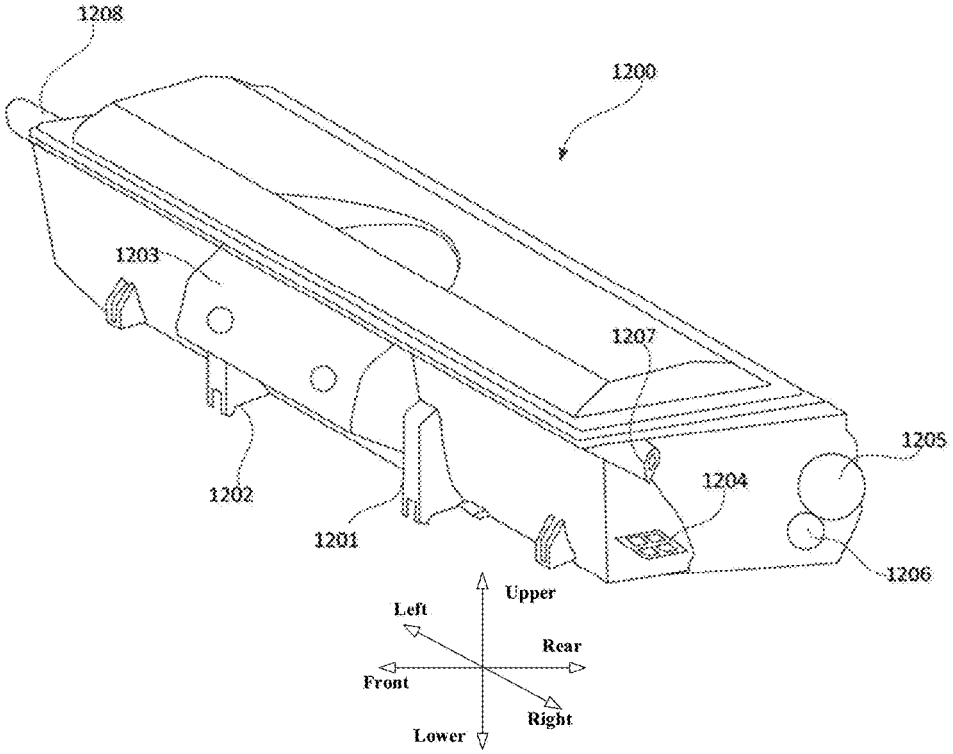
FIG. 12 is a schematic structural diagram of a toner cartridge according to a fifth exemplary embodiment of the present disclosure.

Based on the foregoing exemplary embodiments, the structure of the developing cartridge can be further optimized according to a fifth exemplary embodiment of the present disclosure. As shown in FIG. 11 and FIG. 12, the developing cartridge according to the fifth exemplary embodiment may have a non-integrated structure, i.e. a toner cartridge 1200 for storing developer and a drum assembly 1100 for mounting a photosensitive drum can be detachably assembled.

As shown in FIG. 11 and FIG. 12, to more clearly explain the technical solution according to the fifth exemplary embodiment, front, rear, left, right, upper, and lower are defined according to directions in FIGS. 11 and 12, respectively. A front-to-rear direction is the mounting direction of the developing cartridge.

As shown in FIG. 11, the drum assembly 1100 may include a toner cartridge mounting part 1101 configured to mount the toner cartridge 1200, lock members 1106 and 1107 configured to lock the toner cartridge 1200, a photosensitive drum 1102, and a waste toner chamber 1103 configured to store waste toner. Also, a drive unit 1105 may be disposed at an end of the right side of the photosensitive drum 1102 and configured to receive a driving force; and a waste toner outlet 1108 may be disposed a right side wall of the waste toner chamber 1103 and configured to discharge the waster toner. The drum assembly 1100 may further include a first storage member 1104 located close to a rear side of a frame of the drum assembly 1100, and the first storage member 1104 may include a storage unit. The storage unit may be EEPROM, and parameters stored in the store unit may include at least one parameter of: rotation period of the photosensitive drum, usage of the drum assembly, a maximum capacity of the waste toner chamber for storing the waste toner, or amount of waste toner stored in the waster toner chamber. The first storage member 1104 may be disposed on an upper surface of the waster toner chamber 1103 and located at a left side of an axis of the photosensitive drum 1105. That is, the first storage member 1104 may be disposed on an upper surface and close to a left side of the frame of the drum assembly 1100. Therefore, contacts on the first storage member 1104 may be away from the outlet 1108 of the waste toner chamber 1103, and it is possible to prevent the first storage member 1104 being contaminated during a discharging process of the waster toner.

As shown in FIG. 12, the toner cartridge 1200 may include abutments 1201 and 1202, configured to respectively cooperate with the lock members 1106 and 1007, a holder 1203 configured to facilitate a user for mounting, a toner roller 1206 configured to transport the toner from the toner cartridge to a developing roller 1205. When the toner cartridge 1200 is mounted to the drum assembly 1100, the developing roller 1205 can transport the toner from the toner cartridge 1200 to the surface of the photosensitive drum 1102. A second storage member 1204 may be disposed on a lower surface of the toner cartridge 1200. The mounting location of second storage member on the toner cartridge may be a location close to a front surface and right surface of the toner cartridge. The second storage member 1204 may also include a storage unit, and the storage unit may include at least one parameter of: a maximum amount of waste toner that the toner cartridge can store, amount of waste toner that is stored in the toner cartridge, usage of the toner cartridge, a manufacturer of the toner cartridge, or a production date of the toner cartridge. The second storage member 1204 is close to the front surface and away from the developing roller 1205, therefore, the toner on the surface of the developing roller cannot be splashed onto the surface of the storage member 1204, preventing the second storage member 1204 being contaminated. Also, compared to the design that the storage member is disposed on the right side wall of the toner cartridge, during the mounting process of the toner cartridge, the design that the second storage member 1204 is disposed on the lower surface of the toner cartridge can prevent the second storage member 1204 from touching a high voltage contact that is disposed on the main body of the printer and configured to provide electrical power to the side wall of the toner cartridge.

It should be noted that, the first storage member and the second storage member described above are only intended to allow those skilled in the art to clearly understand the present discloser, rather than limit the technical solution according to embodiments of the present disclosure. The storage member 1204 on the toner cartridge may also be refereed as the first storage member, and the storage member 1104 on the drum assembly may be the second storage member. In addition, any connection method described in the first to forth exemplary embodiments can be applied to connect the main body of the printer to the contact on at least one of the two storage members according to the fifth exemplary embodiment of the present disclosure. The structure of the toner cartridge and the drum assembly may include but is not limited to the non-integrated structure shown in FIG. 11 and FIG. 12, and may include an integrated structure.

As shown in FIG. 12, the container 1200 may further include two pressing elements 1206 and 1207. The two pressing elements 1206 and 1207 may be protrusions respectively extending from planes of a left side and right side wall of housing of the toner cartridge 1200 to the left side and right side of the toner cartridge. After the toner cartridge 1200 and the drum assembly 1100 are mounted to the main body of the printer, the pressing elements 1206 and 1207 can receive a downward pressure from the main body of the printer. Also, a force (a first force) from the main body of the printer received by the pressing element 1207 on the right side of the toner cartridge can cancel out part of an elastic force (a second force) from the contacting members on the printer received by the storage member 1204, such that the toner cartridge can be stably mounted to the printer. It should be noted that the pressing elements 1206 and 1207 extending from the planes of the left side wall and the right side wall of the toner cartridge include not only starting extending directly from the plane of the left side wall and the right side wall, but also starting extending from the upper surface of the housing of the toner cartridge, through spatial plans corresponding to the plans of the left and right side wall, to the left and right side, respectively of the toner cartridge.

Optionally, the first force and the second force may be in opposite directions along the upper-lower direction in FIG. 12. It should be noted that the opposite directions here may not be necessarily directions with strictly 180° difference, but approximately opposite directions.

Figure 13:
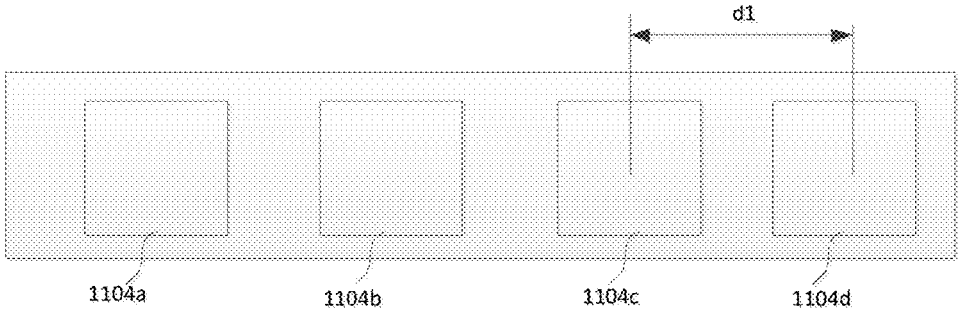
FIG. 13 is a schematic structural view of a storage member on the drum assembly shown in FIG. 11.
Figure 14:
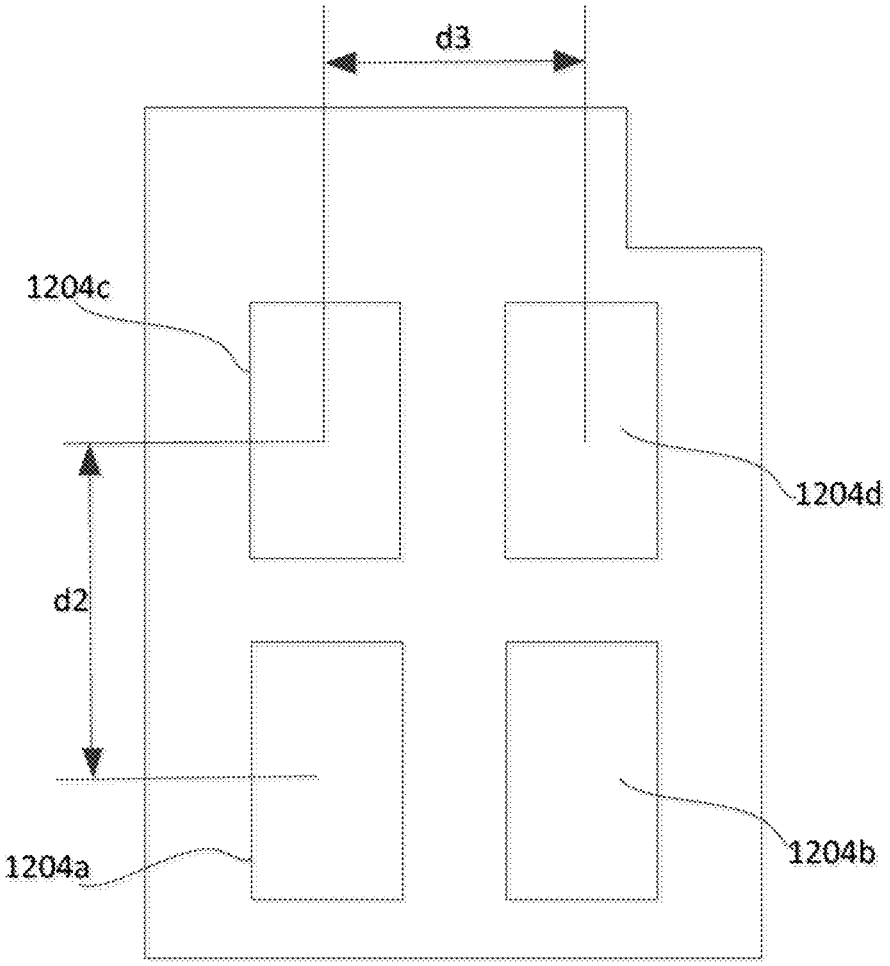
FIG. 14 is a schematic structural view of a storage member on the toner cartridge shown in FIG. 12.

As shown in FIG. 13, contacts 1104*a*, 1104*b*, 1104*c*, 1104*d* on the first storage member may be arranged in a row, and d1 is a center-to-center distance of abutment areas between contacts on the storage member and the contacting members on a printer. As shown in FIG. 14, contacts 1204*a*, 1204*b*, 1204*c*, 1204*d* on the first storage member may be arranged in two rows along the axis direction of the photosensitive drum. d3 is a distance between a center of abutment area of the contact 1204*c* with the contacting member on the printer and a center of abutment area of the contact 1204*d* with the contacting member on the printer. In a front-rear direction (perpendicular to the axis of the photosensitive drum, and approximately parallel to the side wall of the toner cartridge), d2 is a center-to-center distance of abutment areas between each contact on the storage member and each contacting member on the printer. Optionally, d1>d2 and d1>d3. The advantage of the above arrangement may be that, when the drum assembly is mounted to the printer, there may be enough space for the contacts on the first storage member to include a large conductive section on each of the contacts. Therefore, even though there is a big gap for the contacting members of printer to cooperate with the drum assembly, the first storage member can still be well connected to the contacting members in the printer. In the process of mounting the toner cartridge into the drum assembly 1100, because the drum assembly includes a guide rail configured to guide the mounting of the toner cartridge, the offset of the toner cartridge in the left-right direction is little. Even through a conductive section of the contacts on the second storage member is relatively small, the contacting members of the printer can still be well connected to the contacts of the second storage member. In addition, after the mounting process of the toner cartridge is completed, the cooperation gap between the drum assembly and the toner cartridge is relatively small, therefore, in the frond-to-rear direction, the movement range of the toner cartridge may be relatively small, and stable connections of contacts can still be satisfied even if d2 is smaller than d1.

Above are disclosed embodiments of the present disclosure. But the above contents are merely embodiments for facilitating the understanding of the present disclosure and are not intended to limit the present disclosure. Those skilled in the art to which the present disclosure belongs can make any modifications and changes in the form and details of the implementation without departing from the spirit and scope of the present disclosure. However, the protection scope of the present disclosure is defined in the appended claims.

What is claimed is:

1. A toner cartridge for an image forming device, comprising:

a housing including:

a toner chamber configured to store toner, and a developing roller dispose at a rear side of the housing; and a first storage member disposed on a lower surface of the housing and configured to store information of the toner cartridge, wherein, with respect to the rear side of the housing for disposing the developing roller, the first storage member is located closer to a front side of the housing opposite to the rear side.

2. The toner cartridge according to claim 1, wherein:

the toner cartridge further includes a pressure receiving element extending from a left side or a right side wall of the toner cartridge, and after the toner cartridge is mounted to the image forming apparatus, the pressing element receives a first force from the image forming apparatus, the first storage member receives a second force from the image forming apparatus, and a direction of the first force is opposite to a direction of the second force.

3. The toner cartridge according to claim 1, wherein:

two rows of contacts are disposed on the first storage member, a first row of contacts disposed close to the developing roller including a voltage common collector (VCC) contact and a ground (GND) contact, a second row of contacts including a plurality of signal contacts;

the image forming apparatus includes a main body, the main body comprising contacting members configured to be respectively connected to the VCC contact, the GND contact and the signal contacts; and in a process of mounting the toner cartridge to the image forming apparatus, the GND contact is connected to a corresponding contacting member in the main body earlier than the VCC contact being connected to a corresponding contacting member in the main body; and the VCC contact is connected to the corresponding contacting member in the main body earlier than the signal contacts being connected to corresponding contacting members in the main body.

4. The toner cartridge according to claim 1, wherein two rows of contacts are disposed on the first storage member, a first row of contacts disposed close to the developing roller including a voltage common collector (VCC) contact and a ground (GND) contact, a second row of contacts including a plurality of signal contacts;

the image forming apparatus includes a main body, the main body comprising contacting members configured to be respectively connected to the VCC contact, the GND contact and the signal contacts; and in a process of removing the toner cartridge from the image forming apparatus, the signal contacts are disconnected from corresponding contacting members in the main body earlier than the VCC contact being disconnected from a corresponding contacting member in the main body; and the VCC contact is disconnected from the corresponding contacting member in the main body earlier than the GND contact being disconnected from a corresponding contacting member in the main body.

5. A developing cartridge for an image forming apparatus, comprising:

a drum assembly configured to support a photosensitive drum, and a toner cartridge including a housing, the housing including:

a toner chamber configured to store toner, and a developing roller disposed at a rear side of the housing; and a first storage member disposed on a lower surface of the housing and configured to store information of the toner cartridge, wherein, with respect to the rear side of the housing for disposing the developing roller, the first storage member is located closer to a front side of the housing opposite to the rear side.

6. The developing cartridge according to claim 5, wherein:

a second storage member is disposed on an upper surface of the drum assembly and configured to store information of the drum assembly.

7. The developing cartridge according to claim 6, wherein:

the drum assembly includes a row of contacts of the second storage member; and the second storage member is located close to a rear side of a frame of the drum assembly.

8. The developing cartridge according to claim 6, wherein:

a waste toner outlet is disposed at a right side of the drum assembly and configured to discharge waste toner; and the second storage member is located on an upper surface and close to a left side of a frame of the drum assembly.

9. The developing cartridge according to claim 6, wherein:

d1 is a center-to-center distance of abutment areas between contacts on the storage member and the contacting members on a printer;

d2 is a distance between centers of abutment areas of the contacts in the first row on the storage member with the contacting members on the printer and centers of abutment areas of the contacts in the second row on the storage member with the contacting members on the printer;

d3 is a center-to center distance of abutment areas between the contacts in the first row on the storage member with the contacting members on the printer; and d1>d2 and d1>d3.

10. An image forming apparatus comprising:

an main body for mounting a toner cartridge or a developing cartridge and including contacting members configured to be connected to contacts on a first storage member of the storage member of a toner cartridge or a second storage member of the developing cartridge, wherein:

the toner cartridge includes a housing and a first storage member, the housing including a toner chamber configured to store toner, and a developing roller disposed at a rear side of the housing, and the first storage member being disposed on a lower surface of the housing and configured to store information of the toner cartridge, wherein, with respect to the rear side of the housing for disposing the developing roller, the first storage member is located closer to a front side of the housing opposite to the rear side; and the developing cartridge includes the toner cartridge and a drum assembly configured to support a photosensitive drum.

11. The apparatus according to claim 10, wherein:

the toner cartridge further includes a pressure receiving element extending from a left side or a right side wall of the toner cartridge, and after the toner cartridge is mounted to the image forming apparatus, the pressing element receives a first force from the image forming apparatus, the first storage member receives a second force from the image forming apparatus, and a direction of the first force is opposite to a direction of the second force.

12. The apparatus according to claim 10, wherein:

two rows of contacts are disposed on the first storage member, a first row of contacts disposed close to the developing roller including a voltage common collector (VCC) contact and a ground (GND) contact, a second row of contacts including a plurality of signal contacts;

the image forming apparatus includes a main body, the main body comprising contacting members configured to be respectively connected to the VCC contact, the GND contact and the signal contacts; and in a process of mounting the toner cartridge to the image forming apparatus, the GND contact is connected to a corresponding contacting member in the main body earlier than the VCC contact being connected to a corresponding contacting member in the main body; and the VCC contact is connected to the corresponding contacting member in the main body earlier than the signal contacts being connected to corresponding contacting members in the main body.

13. The apparatus according to claim 10, wherein two rows of contacts are disposed on the first storage member, a first row of contacts disposed close to the developing roller including a voltage common collector (VCC) contact and a ground (GND) contact, a second row of contacts including a plurality of signal contacts;

the image forming apparatus includes a main body, the main body comprising contacting members configured to be respectively connected to the VCC contact, the GND contact and the signal contacts; and in a process of removing the toner cartridge from the image forming apparatus, the signal contacts are disconnected from corresponding contacting members in the main body earlier than the VCC contact being disconnected from a corresponding contacting member in the main body; and the VCC contact is disconnected from the corresponding contacting member in the main body earlier than the GND contact being disconnected from a corresponding contacting member in the main body.

14. The apparatus according to claim 10, wherein:

a second storage member is disposed on an upper surface of the drum assembly and configured to store information of the drum assembly.

15. The apparatus according to claim 14, wherein:

the drum assembly includes a row of contacts of the second storage member; and the second storage member is located close to a rear side of a frame of the drum assembly.

16. The apparatus according to claim 14, wherein:

a waste toner outlet is disposed at a right side of the drum assembly and configured to discharge waste toner; and the second storage member is located on an upper surface and close to a left side of a frame of the drum assembly.

17. The apparatus according to claim 14, wherein:

d1 is a center-to-center distance of abutment areas between contacts on the storage member and the contacting members on a printer;

d2 is a distance between centers of abutment areas of the contacts in the first row on the storage member with the contacting members on the printer and centers of abutment areas of the contacts in the second row on the storage member with the contacting members on the printer;

d3 is a center-to center distance of abutment areas between the contacts in the first row on the storage member with the contacting members on the printer; and d1>d2 and d1>d3.

* * * * *